US011179021B2

(12) United States Patent
Marzorati

(10) Patent No.: US 11,179,021 B2
(45) Date of Patent: Nov. 23, 2021

(54) DISHWASHER

(71) Applicant: ELECTROLUX APPLIANCES AKTIEBOLAG, Stockholm (SE)

(72) Inventor: Luca Marzorati, Porcia (IT)

(73) Assignee: Electrolux Appliances Aktiebolag

( * ) Notice: Subject to any disclaimer, the term of this patent is extended or adjusted under 35 U.S.C. 154(b) by 16 days.

(21) Appl. No.: 16/309,720

(22) PCT Filed: Jun. 30, 2016

(86) PCT No.: PCT/EP2016/065407
§ 371 (c)(1),
(2) Date: Dec. 13, 2018

(87) PCT Pub. No.: WO2018/001497
PCT Pub. Date: Jan. 4, 2018

(65) Prior Publication Data

US 2019/0133407 A1 May 9, 2019

(51) Int. Cl.
*A47L 15/42* (2006.01)

(52) U.S. Cl.
CPC ..... *A47L 15/427* (2013.01); *A47L 15/4253* (2013.01)

(58) Field of Classification Search
CPC ... A47L 15/427; A47L 15/4253; F25D 23/028
USPC ..... 248/544, 546, 686, 674, 675, 207, 212, 248/216.1, 217.4, 274.1, 287.1, 298.1, 248/506, 222.52, 223.41, 224.8, 225.11, 248/188, 188.3, 188.4
See application file for complete search history.

(56) References Cited

U.S. PATENT DOCUMENTS 4,009,918 A * 3/1977 MacDonald ..... A47B 77/02 312/351.3
4,462,225 A * 7/1984 Noe ..... D06F 39/125 248/121

(Continued)

FOREIGN PATENT DOCUMENTS

DE 75 34 416 U 8/1976
DE 10 2011 004315 A1 8/2012

(Continued)

OTHER PUBLICATIONS

International Search Report and Written Opinion for Application No. PCT/EP2016/065407 dated Feb. 20, 2017, 10 pages.

(Continued)

*Primary Examiner* — Eret C McNichols
*Assistant Examiner* — Michael McDuffie
(74) *Attorney, Agent, or Firm* — RatnerPrestia

(57) ABSTRACT

Embodiments of a dishwasher may include a frame defining a treatment chamber for items to be washed, and at least one coupling system for coupling the frame to furniture walls. Each one of the at least one coupling system may include a support element coupled with the frame with the possibility of moving with respect to the frame, the support element being further adapted to be fixed to a corresponding furniture wall by means of a fastening member; and a regulation element coupled with the support element and operable to cause a movement of the frame with respect to the support element after the support element is fixed to the corresponding furniture wall.

18 Claims, 8 Drawing Sheets

(56) References Cited

U.S. PATENT DOCUMENTS 4,659,047 A * 4/1987 Haller ..... A47B 96/067 248/274.1
4,669,695 A * 6/1987 Chou ..... A47B 97/00 248/154
4,753,406 A * 6/1988 Kodama ..... A47B 77/02 248/327
4,763,868 A * 8/1988 Teich ..... A47B 91/022 16/18 R
5,005,325 A * 4/1991 Dull ..... E04B 2/7425 248/188.4
5,029,791 A * 7/1991 Ceccon ..... G02B 7/004 248/287.1
5,076,525 A * 12/1991 Whipple ..... A47B 97/00 248/300
6,222,171 B1 * 4/2001 Fukuda ..... A47B 77/08 219/702
6,460,820 B1 * 10/2002 Kopp ..... F16M 7/00 248/500
6,729,590 B2 * 5/2004 Gabriel ..... A47L 15/4253 248/188.2
7,185,874 B2 * 3/2007 Deiss ..... A47B 77/08 248/674
7,240,889 B2 * 7/2007 Giovinazzi ..... D06F 37/20 248/501
8,220,760 B2 * 7/2012 Fetzer ..... A47B 91/028 248/188.4
8,276,859 B1 * 10/2012 Caddell ..... F16M 7/00 248/188.4
8,511,768 B2 8/2013 Brachert
8,602,374 B2 * 12/2013 Jerg ..... A47L 15/427 248/364
9,163,842 B2 * 10/2015 Adams ..... A47B 91/02
9,303,916 B2 * 4/2016 Ozyuksel ..... F25D 23/10
9,578,965 B2 * 2/2017 Hamaba ..... G03G 21/1685
10,034,597 B1 * 7/2018 Maddux ..... A47L 15/507
10,352,026 B2 * 7/2019 Lloyd ..... A47B 77/06
10,359,212 B2 * 7/2019 Darby ..... F24F 1/027
2003/0010886 A1 * 1/2003 Barnes ..... D06F 39/12 248/680
2005/0247834 A1 * 11/2005 Thuelig ..... F16M 7/00 248/188.4
2007/0205342 A1 * 9/2007 Gabriel ..... F16M 7/00 248/188.4
2007/0240395 A9 * 10/2007 Kentner ..... F25D 23/067 55/507
2008/0168855 A1 * 7/2008 Giefer ..... D06F 39/125 74/412 R
2008/0272267 A1 * 11/2008 Kristensson ..... A47L 15/427 248/675
2011/0297802 A1 * 12/2011 Gennaretti ..... A47L 15/4253 248/188.4
2012/0037775 A1 * 2/2012 Sangiuliano ..... F16M 13/02 248/274.1
2012/0194047 A1 * 8/2012 Kiechle ..... D06F 58/20 312/228
2016/0081474 A1 * 3/2016 Basesme ..... A47B 91/02 248/188.4
2019/0133409 A1 * 5/2019 Marzorati ..... A47L 15/4265

FOREIGN PATENT DOCUMENTS

EP 0 890 806 A2 1/1999
EP 2 127 586 A1 12/2009
EP 2127586 A1 12/2009
EP 2 481 335 A2 8/2012
JP H06197856 7/1994
WO WO 2013/182428 A1 12/2013

OTHER PUBLICATIONS

1st Office Action for China Application No. 201680087212.5 dated Nov. 3, 2020 with English translation (12 pages).

* cited by examiner

Fig 3A
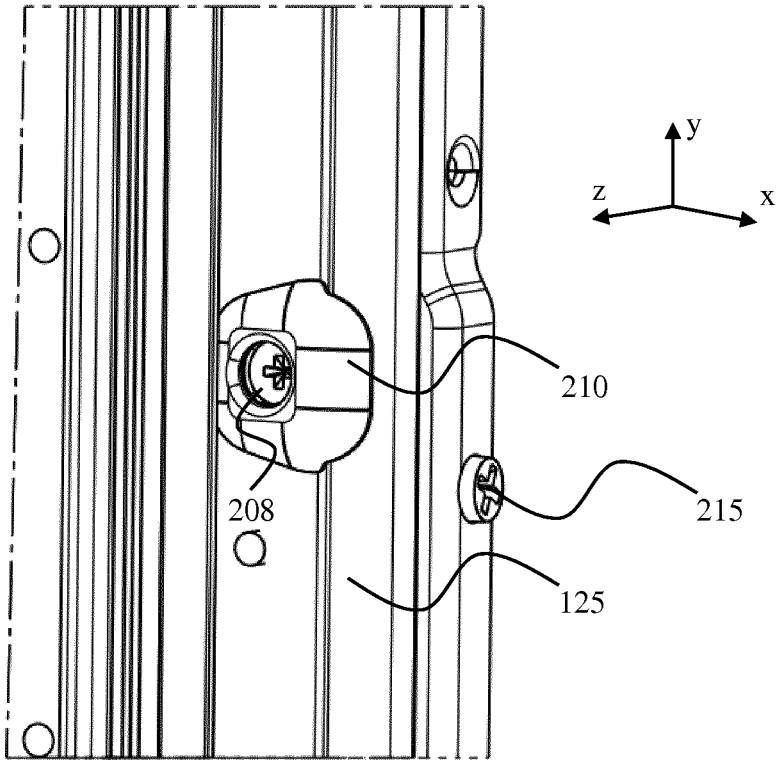
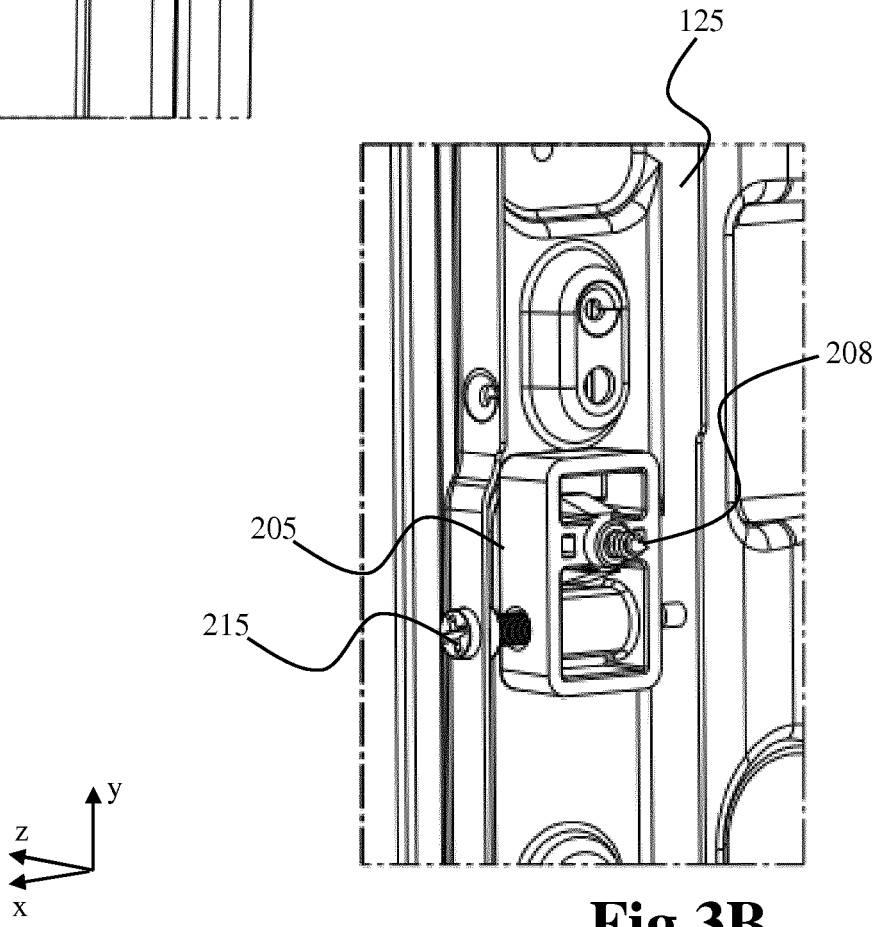
Fig 3B

DISHWASHER

CROSS-REFERENCE TO RELATED APPLICATIONS

This application is a national stage application filed under 35 U.S.C. § 371 of International Application No. PCT/EP2016/065407 filed Jun. 30, 2016, which application is hereby incorporated by reference herein in its entirety.

TECHNICAL FIELD

The solution according to one or more embodiments of the present invention relates to the field of appliances. More specifically, this solution relates to appliances designed to be integrated with furniture pieces.

BACKGROUND ART

Appliances are routinely used to accomplish a number of household functions. Two main broad classes of appliances are available: freestanding appliances and integrated appliances. A freestanding appliance is available as a freestanding apparatus adapted to be operated without anything surrounding it, while an integrated appliance is an apparatus designed to be integrated with other pieces of furniture.

Typically, an integrated appliance is designed to be installed into a corresponding niche defined by other pieces of furniture. The integrated appliance is provided with a decorative front panel—normally with the same appearance of the surrounding pieces of furniture—which is mounted on the appliance itself. With reference in particular to a dishwasher integrated in a kitchen, the dishwasher is called of the built-in type when it has its control panel exposed or of the full-integrated type when it is completely covered by the corresponding decorative front panel; the dishwasher of the full-integrated type is indistinguishable from the adjacent pieces of furniture (even if it requires to be opened to access the control panel).

In order to deliver an aesthetically satisfactory appearance, the edges of the decorative front panel have to be aligned with those of panels/doors of the adjacent pieces of furniture (for example, the dishwasher decorative front panel should be flush with the other kitchen furniture panels when the dishwasher door is closed). For this purpose, in order to install an integrated appliance, additional care should be employed.

Making reference to a dishwasher to be integrated in a niche, a typical installation procedure may provide for the following operations.

Firstly, the dishwasher is inserted in the niche.

Then, the position of the dishwasher within the niche is carefully adjusted to align the edges of the decorative front panel thereof with the edges of the panels/doors of the adjacent pieces of furniture in order to obtain as much as possible a smooth and streamlined look.

Once the dishwasher is correctly positioned, its door is opened in order to access the interior thereof to fix the dishwasher itself to the niche.

The actual fixing is carried out by exploiting fixing elements comprising fastening screws adapted to fasten the dishwasher with corresponding walls of the niche (e.g., lateral walls of the adjacent pieces of furniture). For this purpose, lateral walls of the dishwasher are provided with holes adapted to receive the fastening screws. The fastening screws are inserted in the holes and screwed, piercing the walls of the niche, in such a way to fasten the walls of the dishwasher to the walls of the niche.

For example, each one of the two lateral walls of the dishwasher may be provided, in proximity of the dishwasher front load opening, with an upper hole at an upper portion thereof and a lower hole at a lower portion thereof. In this way, the dishwasher may be advantageously fixed to the niche in a two-step way, i.e., by firstly screwing the fastening screws into the upper holes to preserve the previously obtained dishwasher position, and then by strongly screwing the fastening screws into the lower holes without worrying about possible misalignments caused by such strong screwing action.

However, a procedure of this kind is not really efficient, being affected by a serious drawback.

Indeed, since in order to fasten the dishwasher to the niche, the lateral walls thereof are pierced by the fastening screws, only one attempt is usually allowed for each fastening screw. If a fastening screw was screwed into a niche lateral wall with the dishwasher that is not correctly positioned (i.e., with the edges of the decorative front panel thereof that are not aligned with the edges of the panels/doors of the adjacent pieces of furniture), it means that such lateral wall is pierced in an incorrect position. If the fastening screw is unscrewed to unfasten the dishwasher from the niche in order to carry out a correct repositioning, the presence of the hole in the niche lateral wall which was generated in the previous attempt would hinder the effectiveness of the dishwasher/niche fastening. Indeed, when the fastening screw is screwed again with the dishwasher in the new position, the piercing of the lateral wall would probably occur in a position very close to the already existing hole, with the risk of blending the two holes into a single one (especially if the wall is made of particle board) which is too large for steadily housing the fastening screw.

Different solutions for regulating the positioning of appliance elements are known in the art.

For example, JPH06197856 discloses a dishwasher to be incorporated in a system kitchen. The length of projection of legs from the dishwasher is adjustable through thread means, and an attaching plate adapted to be attached with a cover for covering the lower part of a door is positionally adjustable back and forth by elongated holes and screws, holes and engaging parts, or threaded holes and threaded rods. The cover is positionally adjustable up and down, relative to the attaching plate, by means elongated holes, threaded holes and the like so that the lower edge of the door of the dish washer is aligned with the lower edge of a door of a system kitchen or the lower edge of a front panel, and the front surface of the cover is aligned with the front surface of a skirt part (kick-in part) of the system kitchen while the leg is invisible.

U.S. Pat. No. 8,511,768 discloses a housing for a cabinet-like household appliance, especially a refrigeration device, having a body and at least one door, which is connected to the body in a manner that enables it to swivel due to the provision of at least one first and one second multiple-articulation hinge. The door is supported on an upper supporting surface of the first multiple-articulation hinge and on a lower supporting surface of the second multiple-articulation hinge by means of at least one shim inserted between the door and at least one of the supporting surfaces.

However, Applicant as found that none of the above mentioned solutions known in the art is capable of provide a simplified procedure for installing a dishwasher of the integrated type into a niche in such a way to allow an easy alignment of the edges of the dishwasher decorative front panel with those of panels/doors of the adjacent pieces of furniture.

SUMMARY OF THE INVENTION

In its general terms, a solution according to one or more embodiments of the present invention is based on the idea of providing the dishwasher with coupling systems adapted to be fastened to furniture walls, with these coupling systems that are designed to move with respect to the dishwasher itself.

In the present description, when an entity is said to be "fastened" or "fixed" to another entity, it means that said two entities cannot move related to each other.

A first aspect of a solution according to the invention relates to a dishwasher comprising a frame defining a treatment chamber for items to be washed, and at least one coupling system for coupling the frame to furniture walls.

Each one of said at least one coupling system comprises a support element coupled with the frame with the possibility of moving with respect to the frame. The support element is further adapted to be fixed to a corresponding furniture wall by means of a fastening member.

Each one of said at least one coupling system further comprises a regulation element coupled with the support element and operable to cause a movement of the frame with respect to the support element after the support element is fixed to said corresponding furniture wall.

According to an embodiment of the present invention, said regulation element comprises a regulation screw extending along a first direction parallel to said furniture wall.

According to an embodiment of the present invention, the regulation screw is operable to cause a movement of the frame with respect to the support element along said first direction after the support element is fixed to said corresponding furniture wall.

According to an embodiment of the present invention, said support element comprises a first hole for receiving said fastening member.

According to an embodiment of the present invention, said support element further comprises a second hole extending along the first direction for receiving said regulation screw.

According to an embodiment of the present invention, the dishwasher further comprises a spacer tubular element fitted inside the first hole for receiving said fastening member.

According to an embodiment of the present invention, said support element is coupled with the frame through said regulation screw.

According to an embodiment of the present invention, said support element is located inside a corresponding recess in a wall of the frame.

According to an embodiment of the present invention, said recess comprises a first wall substantially extending along said first direction, and a second wall and a third wall substantially extending along a second direction orthogonal to said first direction.

According to an embodiment of the present invention, said regulation screw comprises a screw tip contacting said third wall and a screw head in abutment with said second wall.

According to an embodiment of the present invention, said first wall is provided with a third hole adapted to receive said fastening member.

According to an embodiment of the present invention, said second wall is provided with a fourth hole adapted to receive said regulation screw.

According to an embodiment of the present invention, said fastening member comprises one among a fastening screw, a nail, a pin.

According to an embodiment of the present invention, said at least one coupling system comprises a first coupling system coupled with a first lateral wall of the frame and a second coupling system coupled with a second lateral wall of the frame different from the first lateral wall.

According to an embodiment of the present invention, the treatment chamber has a front load opening perpendicular to said first and second lateral walls.

According to an embodiment of the present invention, said first coupling system is located at an upper portion of the first lateral wall close to said front load opening (120).

According to an embodiment of the present invention, said second coupling system is located at an upper portion of the second lateral wall close to said front load opening.

According to an embodiment of the present invention, the dishwasher further comprises a first further hole located at a lower portion of the first lateral wall close to said front load opening for receiving a first further fastening screw, and a second further hole located at a lower portion of the second lateral wall close to said front load opening for receiving a second further fastening screw.

BRIEF DESCRIPTION OF THE DRAWING

A solution according to one or more embodiments of the invention, as well as further features and the advantages thereof, will be best understood with reference to the following detailed description, given purely by way of a non-restrictive indication, to be read in conjunction with the accompanying drawings, wherein corresponding elements are denoted with equal or similar references and their explanation is not repeated for the sake of simplicity. In this respect, it is expressly intended that the figures are not necessary drawn to scale, with some details that may be exaggerated and/or simplified, and that, unless otherwise indicated, they are merely used to conceptually illustrate the structures and procedures described herein. Particularly:

FIG. 3A is a view taken from the inside of the dishwasher treatment chamber showing a portion of a lateral wall wherein a coupling system according to an embodiment of the present invention is provided;

FIG. 3B is a view taken from outside the dishwasher treatment chamber of the portion of lateral wall of FIG. 3A;

DETAILED DESCRIPTION

Figure 1A:
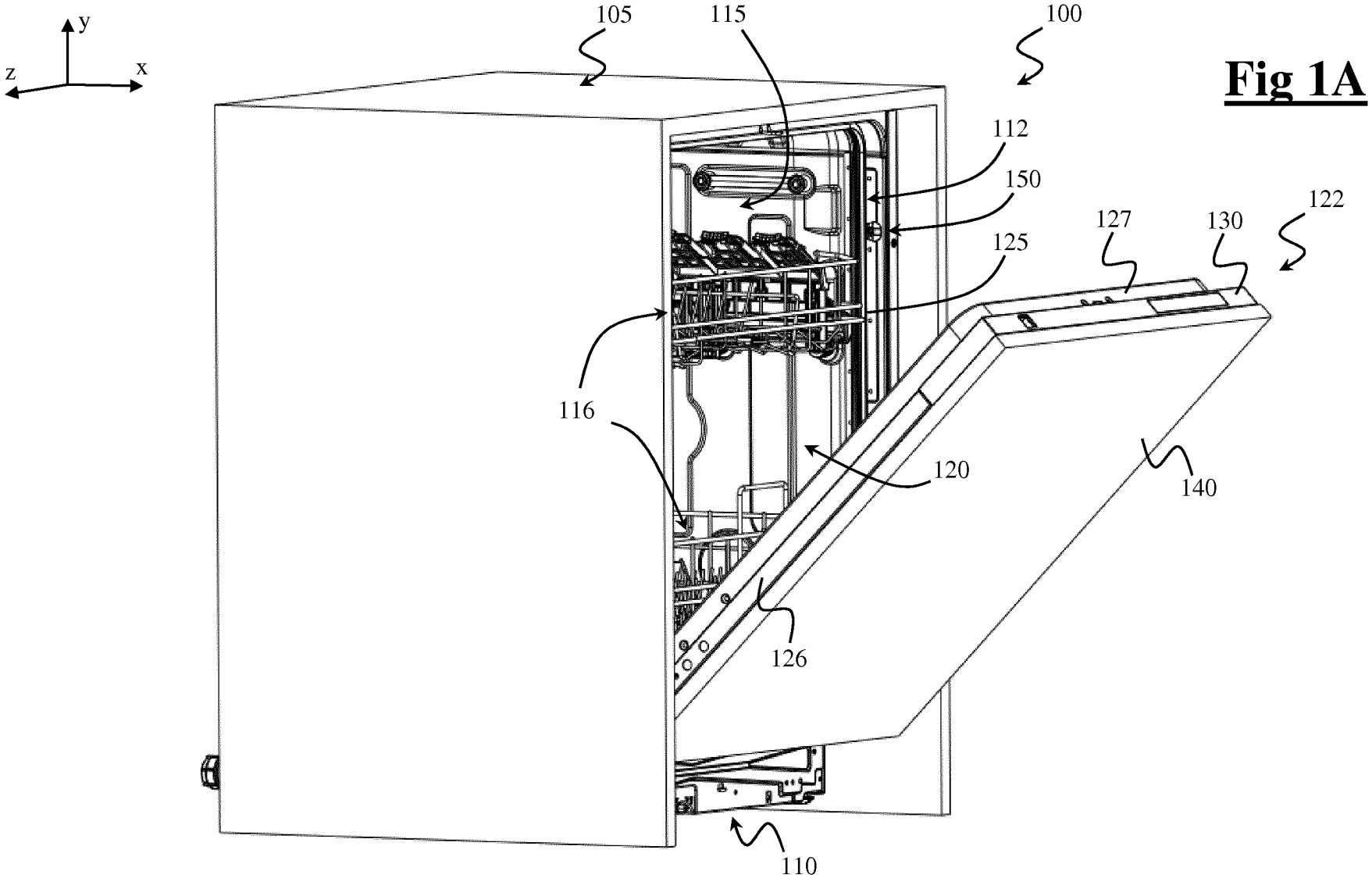
FIG. 1A is a perspective view of a dishwasher, inserted in a niche, to which the solution according to an embodiment of the invention may be applied.
Figure 1B:
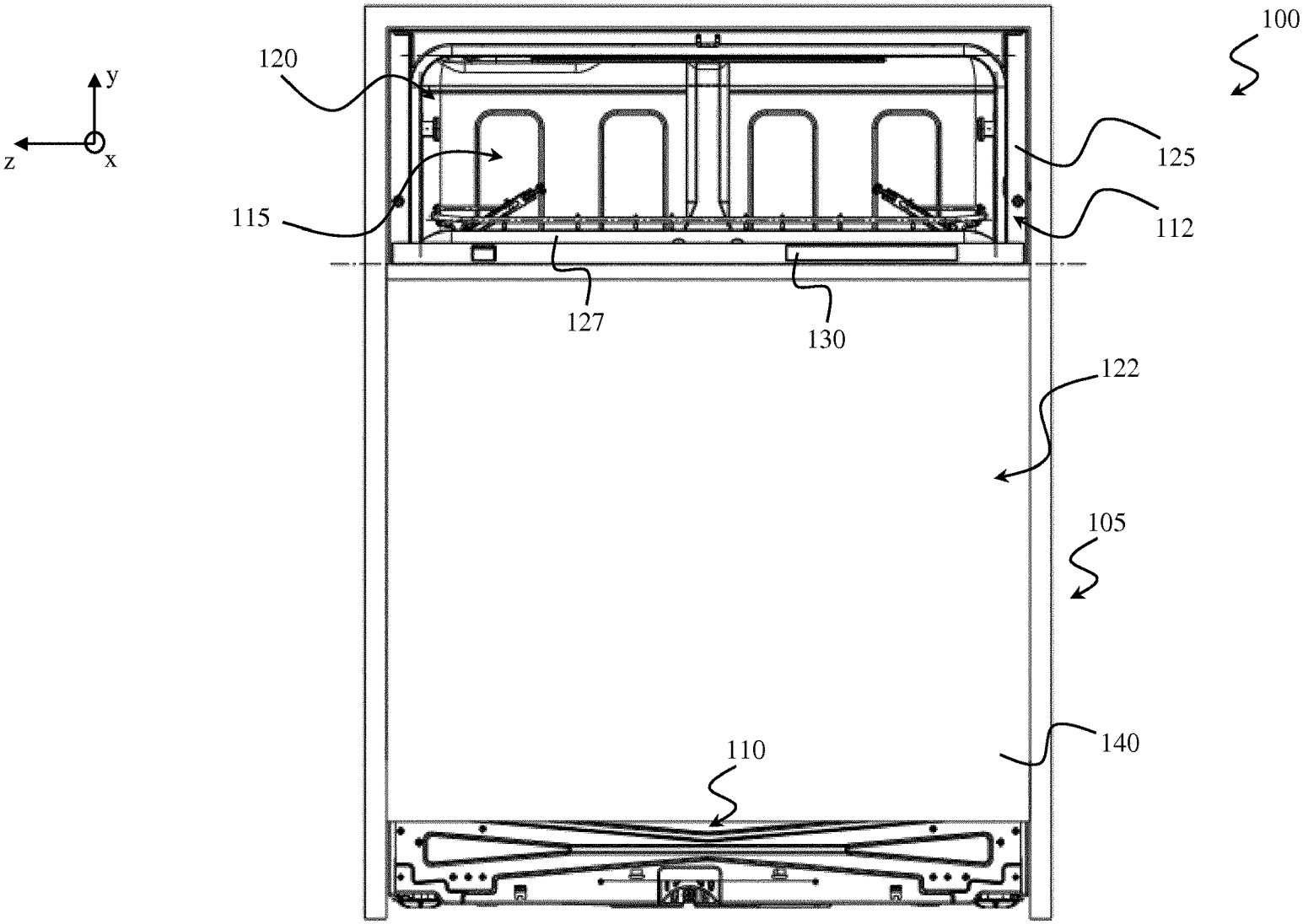
FIG. 1B is a front view of the dishwasher of FIG. 1A.

With reference in particular to FIGS. 1A and 1B, an exemplary integrated dishwasher 100, to which the solution according to an embodiment of the invention may be applied, is shown. FIG. 1A is a perspective view of the dishwasher 100 inserted in a niche and with the door partially open, while FIG. 1B is a front view of the dishwasher 100.

The dishwasher 100 comprises a base 110 for resting the dishwasher 100 on a support surface (not shown in the figures but parallel to the plane defined by orthogonal directions x and z), such as a floor or a support surface of a suitable niche 105 of a piece of furniture of a kitchen wherein the dishwasher 100 can be installed. The dishwasher 100 comprises a parallelepiped shape body or frame 112 defining an hollow treatment chamber 115 with one or more pullout racks 116, for inserting items to be washed (for example, dishes, cutlery, glasses, pots, pans, and the like). The treatment chamber 115 has a front load opening 120 (parallel to the plane defined by orthogonal directions y and z), closable by a door 122. The frame 112 comprises a top and a bottom walls parallel to the plane defined by directions x and z, a rear wall parallel to the front load opening 120 (i.e., parallel to the plane defined by directions y and z), and two lateral walls 125 orthogonal to the top and bottom walls and orthogonal to the rear wall (i.e., parallel to the plane defined by orthogonal directions x and y). The external faces of the lateral walls 125, i.e., the faces thereof that does not face toward the treatment chamber 115, are usually covered by external side panels, not visible in FIGS. 1A and 1B.

The door 122 comprises an outer door panel 126 and an inner door panel 127. The inner door panel 127 is mounted on a face of the outer door panel 126 facing the treatment chamber 115 when the 122 door is closed. The inner door panel 127 is sized in such a way to abut against borders of the front load opening 120 to seal the treatment chamber 115 when the door 122 is closed.

The door 122 further comprises a control panel 130, which may be mounted on top of the outer door panel 126, in particular flush therewith, so as to be aligned with a top of the frame 112. The door 122 is rotationally coupled to the base 110 by means of lateral hinges (not visible in the figure).

In this way, the door 122 can rotate with respect to the frame 112, around a horizontal rotation axis (raised from the floor), parallel to direction z. Particularly the door 122 can be opened, preferably with a drop-down movement, so as to access the treatment chamber 115 in order to insert the items to be washed and to remove the items being washed. The door 122 can be closed, preferably with a pull-up movement, to enable the operation of the dishwasher.

The dishwasher 100 is of the full-integrated type, so as to be totally indistinguishable from other pieces of furniture of the kitchen when it is installed (and the door is closed). For this purpose, the door 122 is completely covered by a decorative front panel 140 (for example, made of wood) with the same appearance as the other pieces of furniture of the kitchen. According to an embodiment of the present invention, the decorative front panel 140 is longer the door 122, so that it projects below the door 122. According to another embodiment of the present invention (not illustrated), the decorative panel 140 has the same length of the door 122. The base 110 has a front recess for avoiding an interference of the decorative front panel 140 with the base 110 when the door 122 is opened.

The dishwasher 100 is designed to be integrated in a niche 105 defined by walls of adjacent pieces of furniture (not shown in the figures). For this purpose, coupling systems are provided at lateral walls 125 of the frame 112 to mechanically couple the dishwasher 100 with the niche 105 walls, i.e., the walls of the adjacent pieces of furniture. For example, two coupling systems may be provided, each one located at an upper portion of a corresponding lateral wall 125 of the frame 112, close to the front load opening 120.

According to an embodiment of the present invention, the coupling systems—identified with reference 150—are adjustable coupling systems, designed to allow (a certain degree of) movement of the dishwasher 100 with respect to the niche 105 walls after the dishwasher 100 itself has been coupled to the niche 105 by means of said coupling systems 150.

Figure 2A:
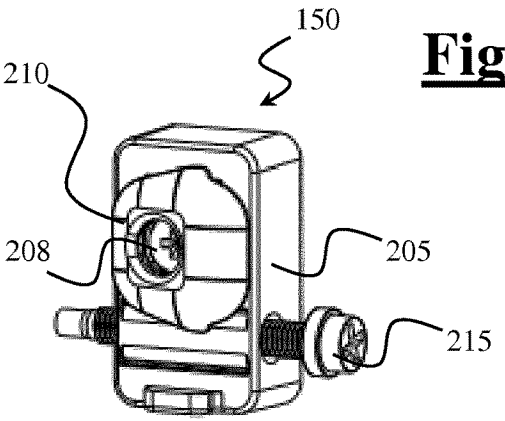
FIG. 2A is a perspective view of a coupling system for the dishwasher of FIGS. 1A and 1B according to an embodiment of the present invention.
Figure 2B:
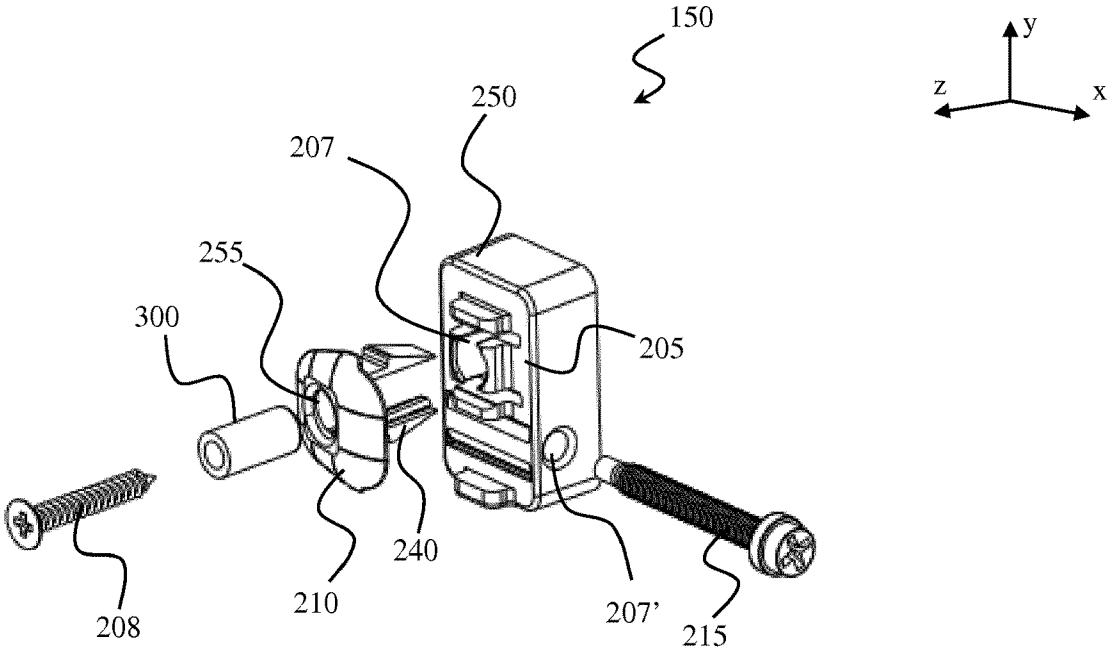
FIG. 2B is an exploded view of the coupling system of FIG. 2A.
Figure 4A:
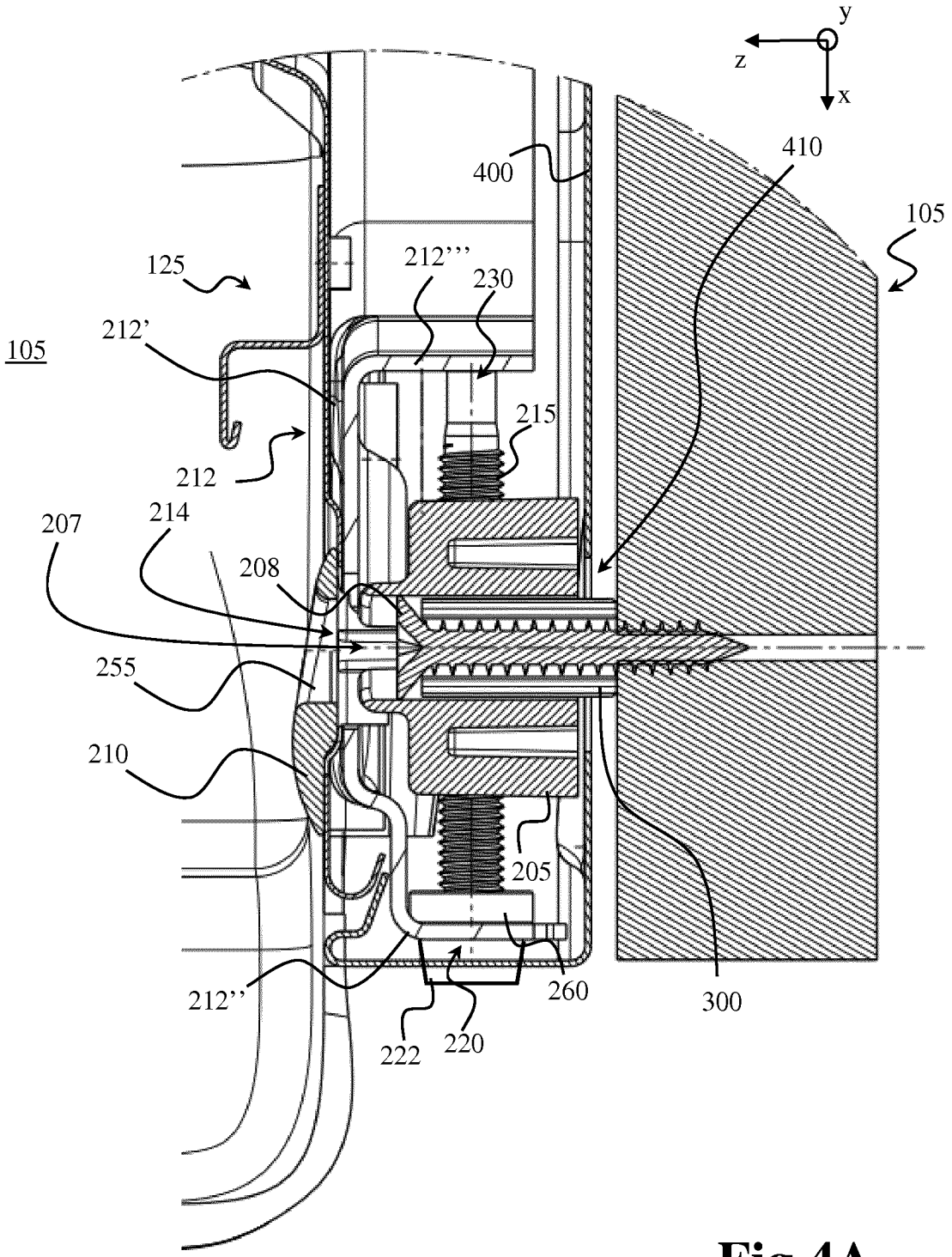
FIGS. 4A and 4B are section views of the portion of lateral wall of FIGS. 3A and 3B.
Figure 4B:
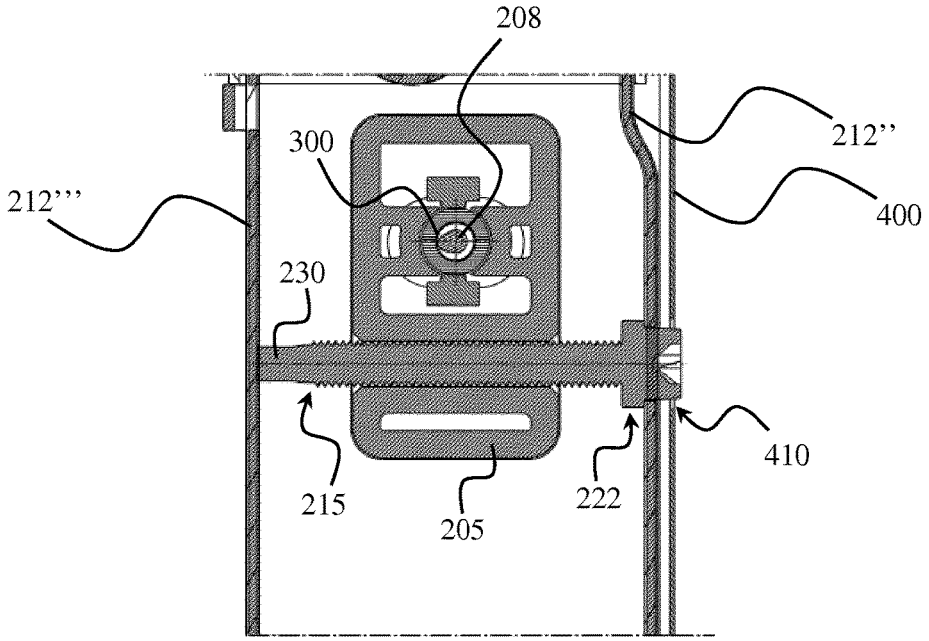

FIG. 2A is a perspective view of a coupling system 150 according to an embodiment of the present invention; FIG. 2B is an exploded view of the coupling system 150 of FIG. 2A. FIGS. 3A and 3B show a portion of a lateral wall 125 of the frame 112 wherein a coupling system 150 according to an embodiment of the present invention is provided; more particularly, FIG. 3A is a view taken from the inside of the treatment chamber 115, while FIG. 3B is a view taken from outside the treatment chamber 115, in which the niche 105 walls as well as the external side panels are removed, to show the structure of the coupling system 150 according to an embodiment of the present invention. FIG. 4A is a section view of the portion of lateral wall 125 of FIGS. 3A and 3B taken along a section plane parallel to the directions x, z and crossing the coupling system 150. In FIG. 4A, the external side panel is visible, and is identified with reference 400. FIG. 4B is a section view of the portion of lateral wall 125 of FIGS. 3A and 3B taken along a section plane parallel to the directions x, y and crossing the coupling system 150.

According to an embodiment of the present invention, the coupling system 150 comprises a support element 205, e.g., having a parallelepiped shape, adapted to be the fastened to a niche 105 lateral wall by means of a fastening member, such as a fastening screw 208, crossing a first hole 207 extending along a direction parallel to direction z (orthogonal or substantially orthogonal to the lateral wall 125). According to an embodiment of the present invention, the fastening screw 208 is fitted inside a spacer tubular element 300 which is in turn fitted inside the first hole 207 (see FIGS. 4A and 4B). According to an embodiment of the present invention, the coupling system 150 further comprises a cap element 210 slidably coupled to the support element 205 and adapted to slide with respect to the support element 205. In this way, the support element 205, once fastened to the niche 105 lateral wall by means of the fastening screw 208, is integral with the niche 105 lateral wall, while the cap element 210 is free to move (slide) with respect to the niche 105 lateral wall. According to an embodiment of the present invention, the cap element 210 is allowed to slide with respect to the support element 205 along a direction parallel to direction x (orthogonal to the front load opening 120).

According to an embodiment of the present invention, once the coupling system 150 is mounted to the dishwasher, the cap element 210 is integral with the lateral wall 125 of the frame 112, and therefore with the dishwasher 100 itself as a whole, while the support element 205 is coupled to the lateral wall 125, and therefore to dishwasher 100, with the possibility of linearly moving with respect to the lateral wall 125, and therefore to dishwasher 100. According to an embodiment of the present invention, the support element 205 is allowed to move with respect to the dishwasher 100 along a direction parallel to direction x.

According to an embodiment of the present invention, the support element 205 is located inside a corresponding recess 212 in the lateral wall 125 comprising a first wall 212' substantially extending along a direction parallel to direction x and provided with a recess hole 214 adapted to be crossed by the fastening screw 208, a second wall 212" substantially extending along a direction parallel to direction z, and a third wall 212'" parallel to the second wall 212".

According to an embodiment of the present invention, the support element 205 is coupled to the lateral wall 125 by means of a regulation element, such as a regulation screw 215 crossing a second (threaded) hole 207' extending in the support element 205 along a direction parallel to direction x (and thus orthogonal to direction z). The regulation screw 215 is inserted in a corresponding hole 220 located at the second wall 212" and comprises a screw head 222 in abutment with such second wall 212", and an opposite end (screw tip) 230 which contacts the third wall 212'". According to an embodiment of the present invention, the end 230 of the regulation screw 215 is fitted in an embossing provided in said third wall 212'". The regulation screw 215 is designed to be operated as a lead screw 215, i.e., it is designed to translate, transform a turning motion of the regulation screw 215 (e.g., applied through a screwdriver) into a linear movement (along a direction parallel to direction x) of the support element 205 with respect to the dishwasher 100.

According to an embodiment of the present invention, the cap element 210 is a substantially flat element provided with tooth elements 240 slidably fitted in corresponding guides 250 located on the support element 205 and extending along a direction parallel to direction x. The cap element 210 is provided with a central hole 255 adapted to be crossed by the fastening screw 208.

Figure 6B:
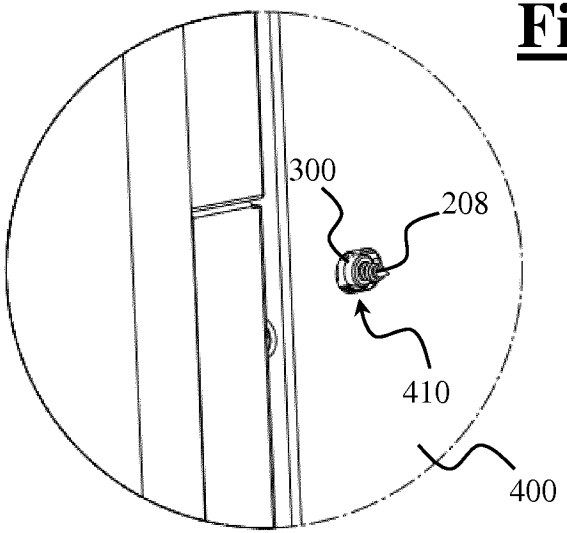
FIG. 6B is an enlarged view of a portion of the external side panel of the dishwasher illustrated in FIG. 6A.
Figure 6A:
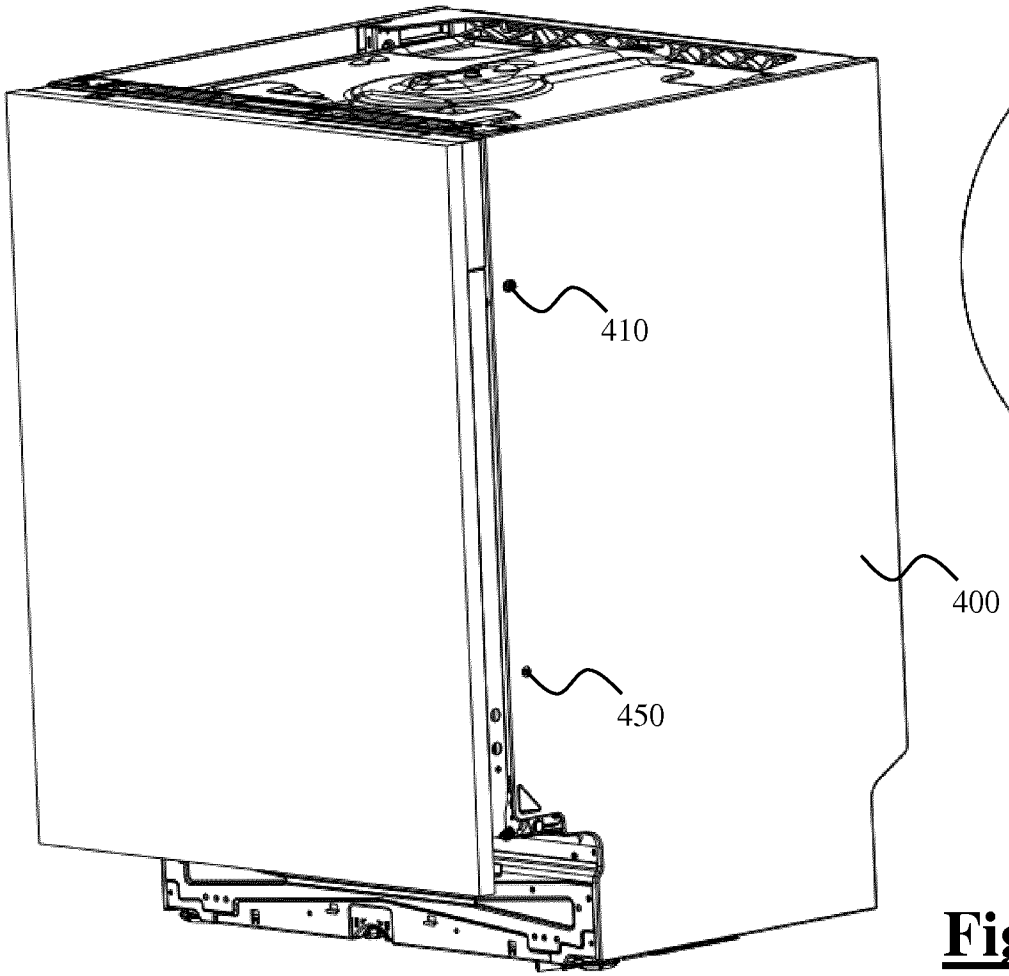
FIG. 6A is a perspective view of the dishwasher of FIGS. 1A and 1B in which the niche is not visible.

As illustrated in FIGS. 6A and 6B, the external side panel 400 is provided with an external hole 410 adapted to be crossed by the fastening screw 208 and by the spacer tubular element 200. FIG. 6B is an enlarged view of the portion of the external side panel 400 of FIG. 6A wherein the external hole 410 is located. As will be described in the following, according to an embodiment of the present invention, the external hole 410 is sufficiently wide (along the direction x) not to hinder relative movement between the dishwasher 100 and the support element 205—spacer tubular element 300—fastening screw 208 assembly; for example, the external hole 410 is a slot elongated in the direction x.

The coupling system 150 is mounted on the dishwasher 100 in the following way. The regulation screw 215 is firstly inserted into the second hole 207' of the support element 205. Then, the support element 205/regulation screw 215 assembly is positioned inside the recess 212 by inserting the screw head 222—from the inside of the recess 212—into the hole 220 at the second wall 212" and making the end 230 of the regulation screw 215 to fit in the embossing provided in the third wall 212'" through a rotational movement.

In this way, the support element 205 results to be coupled with the dishwasher 100 with the possibility of linearly move with respect to the latter. Preferably, in order to prevent the regulation screw 215 from sliding out of the recess 212, the screw head 222 is advantageously provided with a stop collar 260 having a diameter larger than the hole 220 and designed to be in abutment against the internal side of the second wall 212" when the coupling system 150 is mounted on the dishwasher 100.

The support element 205 is positioned in a "neutral" position, in which the first hole 207 is aligned with the recess hole 214 located at the first wall 212' of the recess 212 and with the external hole 410. The cap element 210 is then coupled to the support element 205 by fitting the tooth elements 240 inside the guides 250 through the recess hole 214 from the treatment chamber 115 side. In this condition, the first hole 207, the recess hole 214, the central hole 255 and the external hole 410 are aligned to each other.

The coupling system 150 according to an embodiment of the present invention is exploited to couple the dishwasher 100 to the niche 105 in the following way.

The dishwasher 100 with the door 122 closed is inserted in the niche 105, and the position of the dishwasher 100 within the niche 105 is manually adjusted to align the edges of the decorative front panel 140 with the edges of the panels/doors of the adjacent pieces of furniture.

Once the dishwasher 100 is more or less correctly positioned (coarse positioning), its door 122 is opened in order to access the treatment chamber 115.

At this point, according to an embodiment of the present invention, a spacer tubular element 300 is fitted inside the first hole 207 of the support element 205 through the central hole 255 of the cap element 210 and the recess hole 214 of the recess 212. The spacer tubular element 300 is pushed inside the first hole 207 of the support element 205 so as to protrude outside the dishwasher 100 through the external hole 410 of the external side panel 400 until contacting the niche 105 wall (see FIG. 4A). This is useful for compensating the difference between the size of the dishwasher 100 and the slightly greater size of the niche 105.

Then, the fastening screw 208 is inserted into the spacer tubular element 300—which is in turn fitted inside the first hole 207 of the support element 205—through the central hole 255 of the cap element 210 and the recess hole 214 of the recess 212. The fastening screw 208 is screwed—e.g., by means of a screwdriver through the central hole 255 of the cap element 210 and the recess hole 214—along direction z so as the fastening screw 208 crosses the external hole 410 and pierces the niche 105 wall, fastening thus the support element 205 to the niche 105 wall. It is underlined that the fastening screw 208 is screwed to an extent such that the screwing head thereof reached the inside of the first hole 207 of the support element 205, not to hinder relative movement between the cap element 210 (which is integral with the dishwasher 100) and the support element 205 (which is integral with the niche 105 wall).

These operations are repeated for each coupling system 150 the dishwasher 100 is provided with. In this way, the dishwasher 100 is coupled to the niche 105. However, unlike in the known solutions, wherein once the fastening screws are screwed, the position of the dishwasher 100 with respect to the niche 105 is fixed, the coupling provided by the coupling systems 150 according to an embodiment of the present invention allows to easily adjust the position of the dishwasher 100 with respect to the niche 105 after the screwing of the fastening screw 208.

Figure 5C:
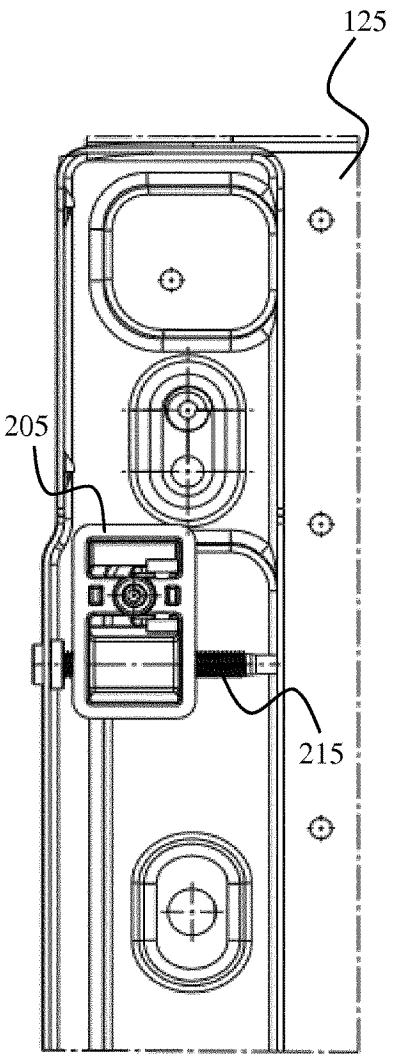
FIGS. 5A-5C illustrate different exemplary relative positions between the support element according to an embodiment of the present invention and the lateral wall of the dishwasher obtained by operating the regulation screw at different positions.
Figure 5B:
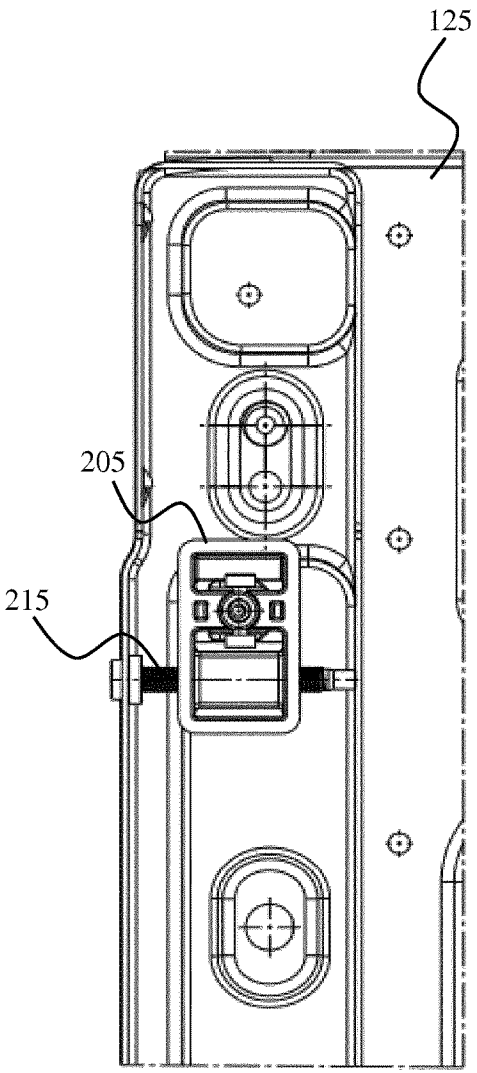
Figure 5A:
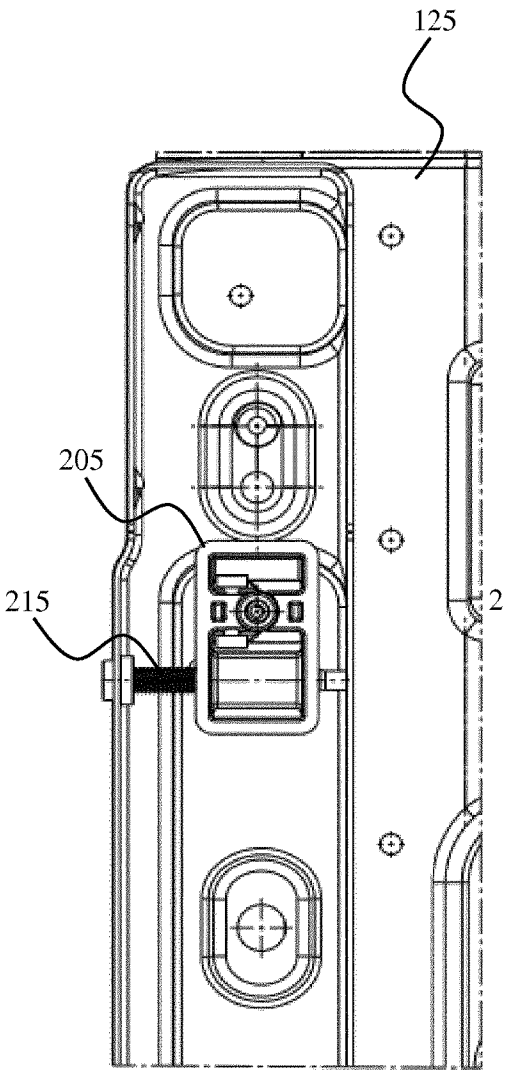

For this purpose, for each coupling system 150, the user may operate the corresponding regulation screw 215—e.g., by using a screwdriver on the corresponding screw head 222—in such a way to rotate the regulation screw 215. Since the support element 205 is integral with the niche 105 wall through the fastening screw 208, the rotation of the regulation screw 215, which causes a translation (along a direction parallel to direction x) of the dishwasher 100 with respect to the support element 205 through the cap element 210, entails in turn a translation of the dishwasher 100 with respect to the niche 105. On this regard, FIGS. 5A-5C illustrate different exemplary relative positions between the support element 205 and the lateral wall 125 of the dishwasher 100 obtained by operating the regulation screw 215 at different positions. Since the external hole 410 provided on the external side panel 400 has the shape of a slot elongated in the direction x, it is avoided that the movement of the dishwasher 100 with respect to the niche 105 is hindered by interference between the external side panel 400 and the fastening screw 208.

By properly operating the regulation screws 215 of each coupling system 150, the user is able to finely tune the position of the dishwasher 100 inside the niche 105 with ease, obtaining the desired alignment of the decorative front panel 140 with the edges of the panels/doors of the adjacent pieces of furniture.

Figure 7A:
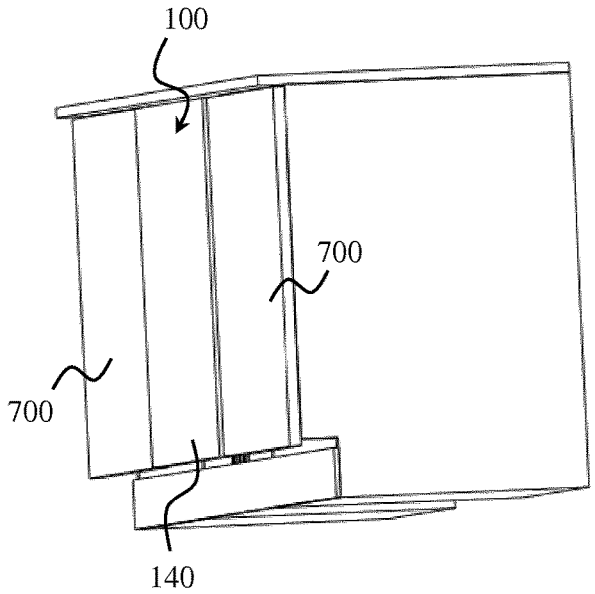
FIGS. 7A and 7B show the dishwasher of FIGS. 1A and 1B in two different positions with respect of adjacent pieces of furniture.
Figure 7B:
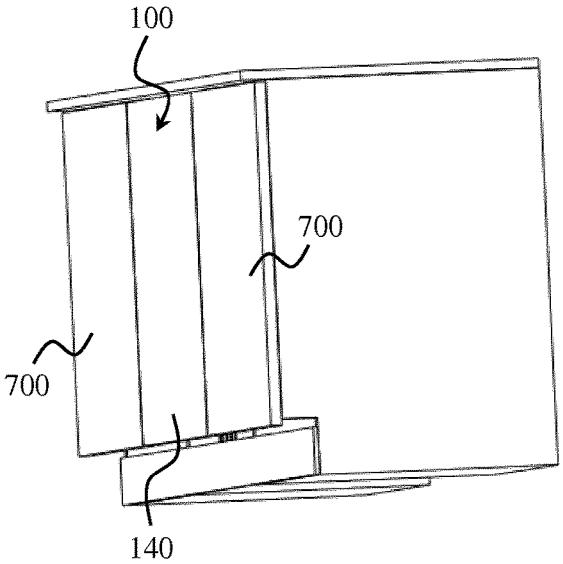

FIGS. 7A and 7B illustrate an example where the dishwasher 100 is installed inside a niche defined by two pieces of furniture 700. As illustrated in FIG. 7A, in the considered example, after the dishwasher 100 coupling to the niche is carried out by means of the coupling system(s) 150, the decorative front panel 140 of the dishwasher is not flush with the front panels of the adjacent pieces of furniture 700. FIG. 7B illustrates the dishwasher 100 position that can be obtained after the operation of the regulation screw(s) 215 of the coupling system(s) 150, i.e., with the decorative front panel 140 aligned to the front panels of the adjacent pieces of furniture 700.

According to an embodiment of the present invention, holes 450 (only one visible in FIG. 6A) are provided at lower portions of the lateral walls 125 of the frame 125—e.g., a hole for each one of the two lateral walls 125—and at corresponding lower portions of the external side panel 400 to receive further fastening screws (not visible in the figures) for strongly fastening the dishwasher 100 to the niche 105 walls after the position of the dishwasher 100 has been finely adjusted through the coupling system(s) 150.

Naturally, in order to satisfy local and specific requirements, a person skilled in the art may apply to the solution described above many logical and/or physical modifications and alterations. More specifically, although this solution has been described with a certain degree of particularity with reference to one or more embodiments thereof, it should be understood that various omissions, substitutions and changes in the form and details as well as other embodiments are possible (for example, with respect to process parameters, materials, and dimensions). Particularly, different embodiments of the invention may even be practiced without the specific details (such as the numerical examples) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the disclosed solution may be incorporated in any other embodiment as a matter of general design choice.

For example, even if in the description the support element of the coupling system has been described as adapted to be fastened to a niche lateral wall by means of a fastening screw, similar considerations apply if a different fastening member is employed, such as for example a nail or a pin.

Moreover, even if reference has been explicitly made to a dishwasher comprising two coupling systems, each one located at a corresponding lateral wall of the dishwasher frame, the concepts of the present invention can be applied as well if a different number of coupling systems is provided, and/or if the coupling systems are positioned at different positions of the frame. For example, a single coupling system may be provided at the top wall of the frame, or four coupling systems may be provided, two for each lateral wall of the frame.

The invention claimed is:

1. A dishwasher comprising a frame having a top wall, a bottom wall, and two lateral walls defining a treatment chamber for items to be washed, the dishwasher including a front door for accessing the treatment chamber, and at least one coupling system for coupling at least one of the two lateral walls of the frame to a furniture wall that is adjacent to the at least one of the two lateral walls, each one of said at least one coupling system comprising:

a support element coupled with the at least one of the two lateral walls of the frame and configured to be movable with respect to the at least one of the two lateral walls of the frame, the support element being further configured to be fixed to said furniture wall by means of a fastening member, a regulation element coupled with the support element and operable to cause a movement of the at least one of the two lateral walls of the frame with respect to the support element and said furniture wall in a direction parallel to said furniture wall after the support element is fixed to said furniture wall.

2. The dishwasher of claim 1, wherein:

said regulation element comprises a regulation screw extending along a first direction parallel to said furniture wall.

3. The dishwasher of claim 2, wherein the regulation screw is operable to cause a movement of the frame with respect to the support element along said first direction after the support element is fixed to said furniture wall.

4. The dishwasher of claim 2, wherein said support element comprises:

a first hole for receiving said fastening member, and a second hole extending along the first direction for receiving said regulation screw.

5. The dishwasher of claim 4, further comprising a spacer tubular element fitted inside the first hole for receiving said fastening member.

6. The dishwasher of claim 3, wherein said support element is coupled with the frame through said regulation screw.

7. The dishwasher of claim 2, wherein said support element is located inside a corresponding recess in the at least one of the two lateral walls of the frame, said recess comprising:

a first wall substantially extending along said first direction;

a second wall and a third wall substantially extending along a second direction orthogonal to said first direction, wherein said regulation screw comprises a screw tip contacting said third wall and a screw head in abutment with said second wall.

8. The dishwasher of claim 7, wherein said first wall is provided with a third hole adapted to receive said fastening member.

9. The dishwasher of claim 7, wherein said second wall is provided with a fourth hole adapted to receive said regulation screw.

10. The dishwasher of claim 1, wherein said at least one coupling system comprises a first coupling system coupled with a first lateral wall of the at least two lateral walls of the frame and a second coupling system coupled with a second lateral wall of the at least two lateral walls of the frame different from the first lateral wall.

11. The dishwasher of claim 10, wherein:

the treatment chamber has a front load opening perpendicular to said first and second lateral walls;

said first coupling system is located at an upper portion of the first lateral wall close to said front load opening, and said second coupling system is located at an upper portion of the second lateral wall close to said front load opening.

12. The dishwasher of claim 11, further comprising:

a first further hole located at a lower portion of the first lateral wall close to said front load opening for receiving a first further fastening screw, and a second further hole located at a lower portion of the second lateral wall close to said front load opening for receiving a second further fastening screw.

13. The dishwasher of claim 1, wherein the furniture wall to which the support element is configured to be fixed is external to and separate from the dishwasher, such that the dishwasher is configured to attach to a separate, fixed surface.

14. The dishwasher of claim 1, wherein the fastening member is configured to be perpendicular to the regulation element in an instance in which the support element is fixed to said furniture wall.

15. A method of installing a coupling system in dishwasher comprising a frame having a top wall, a bottom wall, and two lateral walls defining a treatment chamber for items to be washed, the dishwasher including a front door for accessing the treatment chamber, and at least one coupling system for coupling at least one of the two lateral walls of the frame to a furniture wall that is adjacent to the at least one of the two lateral walls, the method comprising:

coupling a support element with the at least one of the two lateral walls of the frame, the support element configured to be movable with respect to the at least one of the two lateral walls of the frame;

fixing the support element to said furniture wall by means of a fastening member; and coupling a regulation element with the support element, wherein the regulation element is operable to cause a movement of the at least one of the two lateral walls of the frame with respect to the support element and said furniture wall in a direction parallel to said furniture wall after the support element is fixed to said furniture wall.

16. The method of claim 15, wherein:

said regulation element comprises a regulation screw extending along a first direction parallel to said furniture wall.

17. The method of claim 15, further comprising causing, via the regulation screw, a movement of the frame with respect to the support element along said first direction after the support element is fixed to said furniture wall.

18. The dishwasher of claim 1, wherein said support element is located inside a corresponding recess in the at least one of the two lateral walls of the frame.

* * * * *